United States Patent [19]

Erni et al.

[11] Patent Number: 4,656,465

[45] Date of Patent: Apr. 7, 1987

[54] METHOD AND ARRANGEMENT FOR EVALUATING THE PERFORMANCE OF A YARN PROCESSING MACHINE

[75] Inventors: Markus Erni, Winterthur; Kurt Salvisberg, Gächlingen; Marcel Zünd, Winterthur, all of Switzerland

[73] Assignee: Maschinenfabrik Rieter AG, Winterthur, Switzerland

[21] Appl. No.: 715,722

[22] Filed: Mar. 22, 1985

[30] Foreign Application Priority Data

Mar. 22, 1984 [GB] United Kingdom ..... 8407466

[51] Int. Cl.[4] ..... G08B 21/00

[52] U.S. Cl. ..... 340/679; 57/81; 340/522; 340/677; 364/470

[58] Field of Search ..... 340/679, 677, 522; 57/81; 364/470

[56] References Cited

U.S. PATENT DOCUMENTS

| | | | |
|---|---|---|---|
| 3,995,417 | 12/1976 | Lumpert et al. | 340/677 |
| 4,194,349 | 3/1980 | Lane | 57/81 |
| 4,267,554 | 5/1981 | Loepfe et al. | 340/677 |
| 4,375,149 | 3/1983 | Hartmannsgruber | 57/81 |

*Primary Examiner*—Glen R. Swann, III

*Attorney, Agent, or Firm*—Michael J. Striker

[57] ABSTRACT

An arrangement for evaluating the performance of a yarn processing machine including a plurality of yarn processing stations that are individually operatable and each of which includes a monitoring device for the operating conditions thereof and a yarn quality monitoring device capable of detecting yarn quality defects comprises data links which separately supply first signals from the condition monitoring devices and second signals from the yarn quality monitoring devices to an evaluation location. An associating device is situated at the evaluation location, being connected to the data links and operative for associating the second signals which are representative of quality defects with the associated yarn processing stations. The associating device includes two storage devices one of which stores data representative of random yarn breaks at the associated stations while the other stores data representative of quality defects at such stations, and there is further provided an arrangement for entering data into the storage devices in response to those of the second signals which are representative of defective yarn quality at the associated stations, and to those of the first signals which are representative of changes in the conditions of the associated stations that are indicative of yarn breaks at such stations.

3 Claims, 4 Drawing Figures

Fig. 1 (PRIOR ART)
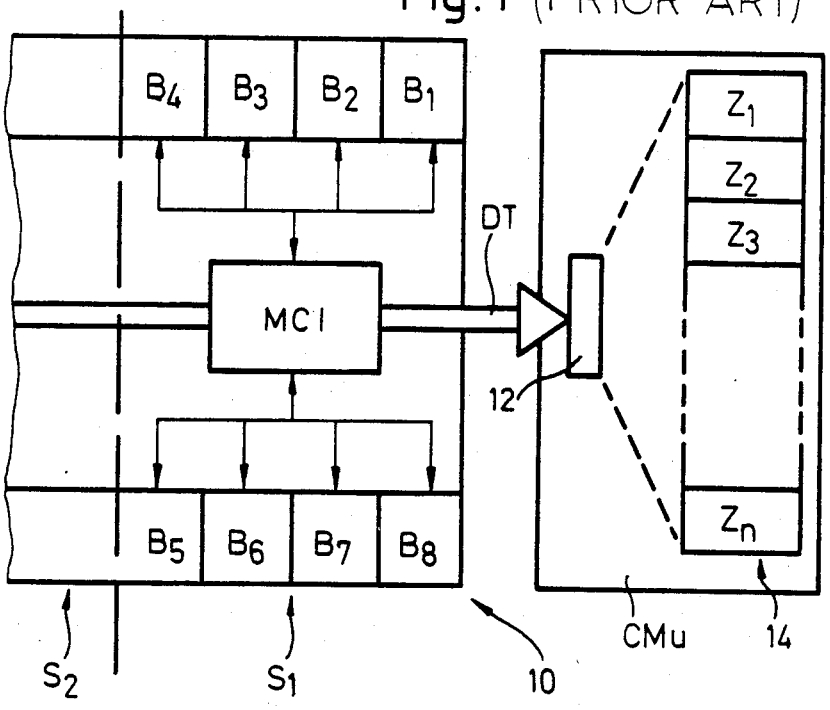
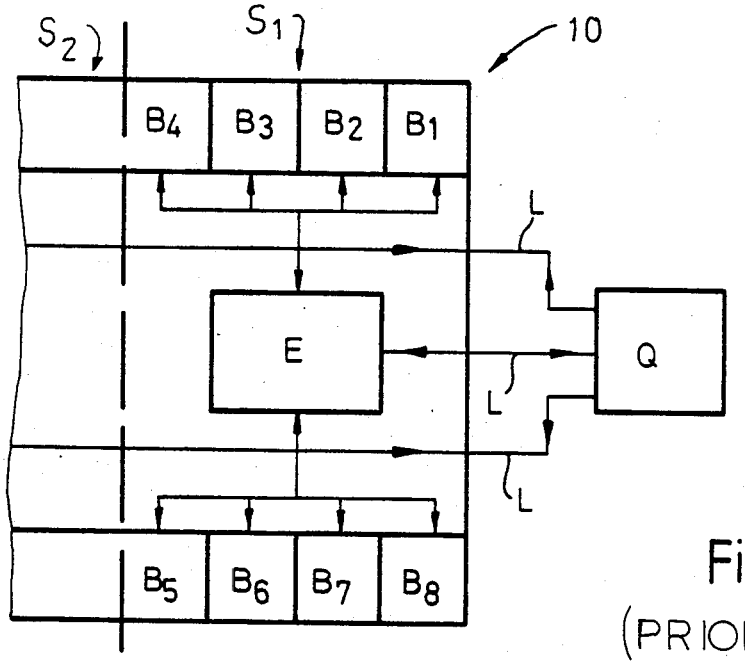
Fig. 2
(PRIOR ART)

METHOD AND ARRANGEMENT FOR EVALUATING THE PERFORMANCE OF A YARN PROCESSING MACHINE

BACKGROUND OF THE INVENTION

The present invention relates to yarn processing machines in general, and more particularly to an arrangement for and a method of supervising the operation or performance of such yarn processing machines.

There are already known various constructions of yarn processing machines, among them such which include a plurality of individually operatable yarn processing stations. Examples of such machines are rotor spinning machines, air-jet of "false-twist" yarn spinning machines, automatic winding machines, and false twist texturizing machines.

The expression "independently operatable" as used in the present disclosure is to be understood as indicating the situation where the processing of yarn at one of the plurality of stations can be terminated or interrupted and later commenced again without affecting in any way the processing of yarn at any other station of the same plurality. However, this expression does not exclude, and actually embraces, the possibility of providing, for example, common drive systems for the yarn processing stations of the plurality, or common services for such stations, such as pneumatic suction systems.

There is a current accelerating trend toward the incorporation of at least limited data processing functions in yarn processing machines of the type mentioned above. Such data processing systems are being offered, on the one hand, by the manufacturers of such yarn processing machines, and on the other hand, by independent suppliers of such equipment, for example the firm Zellweger A.G. of Uster, Switzerland. Systems of this type have been in development over a considerable period of time, as may be ascertained from a collection of articles that have been published in the April 1973 edition of Melliand Textil Berichte.

A common feature of these systems is that the information concerning the current operating condition of each individual yarn processing station is collected and stored in a "condition register" of one kind or another which is incorporated in or otherwise forms a part of a central monitoring unit. The information stored in this condition register is updated at a rate that is dependent upon a predetermined sampling cycle frequency, each processing station being interrogated to determine its current operating condition during each sampling or scanning cycle. A broad outline of systems of this type will be described later in this description. However, since the details of such a system are not crucial for understanding the present invention, and since adequate details are readily ascertainable from the relevant literature which is known or easily accessible to those active in the yarn processing field, such details of the sampling and data transmission systems will be omitted from the present specification.

There is, furthermore, a more recent trend toward providing the machines of the type here under consideration with yarn quality monitoring systems. Such systems are being offered, for instance, by the firm Zellweger A.G. mentioned above, by the firm Otto Stuber KG Textilmachinen-Apparate of Bussingen, Federal Republic Germany, and by the firm Siegfried Peyer of Baech, Schwyz, Switzerland. These systems monitor the yarn leaving the main processing unit of each individual processing station and, in response to the detection of a "defect" at a particular station, they (a) interrupt the operation of that station, and (b) record the occurence of the defect in a "quality defect register" which is shared by all of the monitored stations.

Within the design limits of such a system, the yarn characteristics which may constitute a "defect" can be determined or selected by the machine user, being constituted by a deviation, or a combination of deviations, from some predetermined standard or standards.

A broad outline of a quality monitoring system of this type will be described later in this description. However, once more, since the details of the systems of this kind are not essential to the present invention or its understanding, and since information concerning such details is available from respective patents assigned to the companies offering such systems (and to others), no details of such yarn quality monitoring systems will be, nor need they be, discussed in the present specification. The invention will be readily understood without such details.

As advantageous and useful as these systems may be, however, experience with them has shown that they suffer of many drawbacks, particularly their incapability of gathering and evaluating pertinent data and associating such data with the particular stations at which the problems arise either from time to time, or with a high frequency, so that it is difficult if not impossible when using such known systems to take immediate remedial action at the affected station.

SUMMARY OF THE INVENTION

Accordingly, it is a general object of the present invention to avoid the disadvantages of the prior art.

More particularly, it is an object of the present invention to provide an integrated system or arrangement for evaluating the performance of the individual processing stations of a yarn processing machine, which arrangement does not possess the disadvantages of the known systems.

Still another object of the present invention is so to construct the arrangement of the type here under consideration as to increase the amount and reliability of the information that can be gathered and evaluated by the arrangement, and thus to improve the usefulness of such an arrangement.

It is yet another object of the present invention so to design the arrangement of the above type as to be able to quickly and dependably locate the station that has developed a problem.

A concomitant object of the present invention is to develop an arrangement of the above type which would be simple in construction, inexpensive to manufacture, easy to install and use, and reliable in operation nevertheless.

In pursuance of these objects and others which will become apparent hereafter, one feature of the present invention resides in an arrangement for evaluating the performance of a yarn processing machine having a plurality of independently operatable yarn processing stations each of which can be at any given time in one of its operating and non-operating conditions and is equipped with a condition monitoring device operative for issuing first signals representative of the current condition of the station, and with a yarn quality monitoring device operative for issuing second signals indicative of acceptable and defective yarn quality at the stations, such evaluating arrangement comprising means for separately supplying the first signals from all of the condition monitoring devices and the second signals from all of the yarn quality monitoring devices to an evaluation location; and means situated at the evaluation location and connected to the supplying means for associating the second signals with the appropriate ones of the yarn processing stations. A particular advantage of the arrangement as described as far is that it is capable of indicating the location of the problem.

The first signals can be used, in accordance with the present invention, to change or maintain the contents of a particular cell of a storage register that is so constructed and connected to the condition monitoring means as to store data representing the current operating condition of each individual yarn processing station, this particular cell being allocated to or associated with such individual station.

On the other hand, the associating means includes, according to the instant invention, two storage devices or registers, one for storing data representative of random yarn breaks at the associated stations and the other for storing data representative of quality defects at the associated stations, there being further provided means for entering data into the storage devices in response at least to those of the second signals which are representative of the defective yarn quality at the associated stations, and to those of the first signals which are representative of a change in the condition of the associated station that is indicative of a yarn break at such station. The associating means may further include a switching element capable of assuming two states, this element being set in one of its states when a signal is supplied thereto which indicates the occurrence of a quality defect, and being reset into its other predetermined state when the defect has been allocated or assigned to the proper individual yarn processing station.

The system may then be adapted to respond to a change in the registered condition of an individual processing station that represents the occurrence of a yarn break to store the corresponding data in the one or the other of the two storage devices or registers of the associating means in dependence on the state of the switching element, and to reset this element if it has been previously set into its state indicating a quality defect.

The present invention further provides a method of attributing quality defects to individual yarn processing stations of a yarn processing machine, this method comprising the steps of sensing the occurrence of a yarn break at a particular station by means of a system responsive to the operating conditions of the individual yarn processing stations, producing a signal representative of the occurrence of a quality defect at one of the stations by means of a quality monitoring system, and combining the data from the condition monitoring system with that from the quality monitoring system.

The novel features which are considered as characteristic of the invention are set forth in particular in the appended claims. The improved arrangement for evaluating the performance of a multi-station yarn processing machine itself, however, both as to its construction and its mode of operation, together with additional features and advantages thereof, will be best understood upon perusal of the following detailed description with reference to the accompanying drawing.

BRIEF DESCRIPTION OF THE DRAWING

FIG. 1 is a block diagram of a system for monitoring the operating conditions of the individual yarn processing stations of a yarn processing machine, this condition monitoring system being of a conventional construction and being presented to support a description of a broad outline of the construction and operation of such a system;

FIG. 2 is a block diagram similar to that of FIG. 1 but showing a different system, this one for monitoring the yarn quality at the individual yarn processing stations of the yarn processing machine, this yarn quality monitoring system being also of a conventional construction and being presented here as a basis for a description of a broad outline of the construction and operation of this different system;

DETAILED DESCRIPTION OF THE PREFERRED EMBODIMENTS

Figure 3:
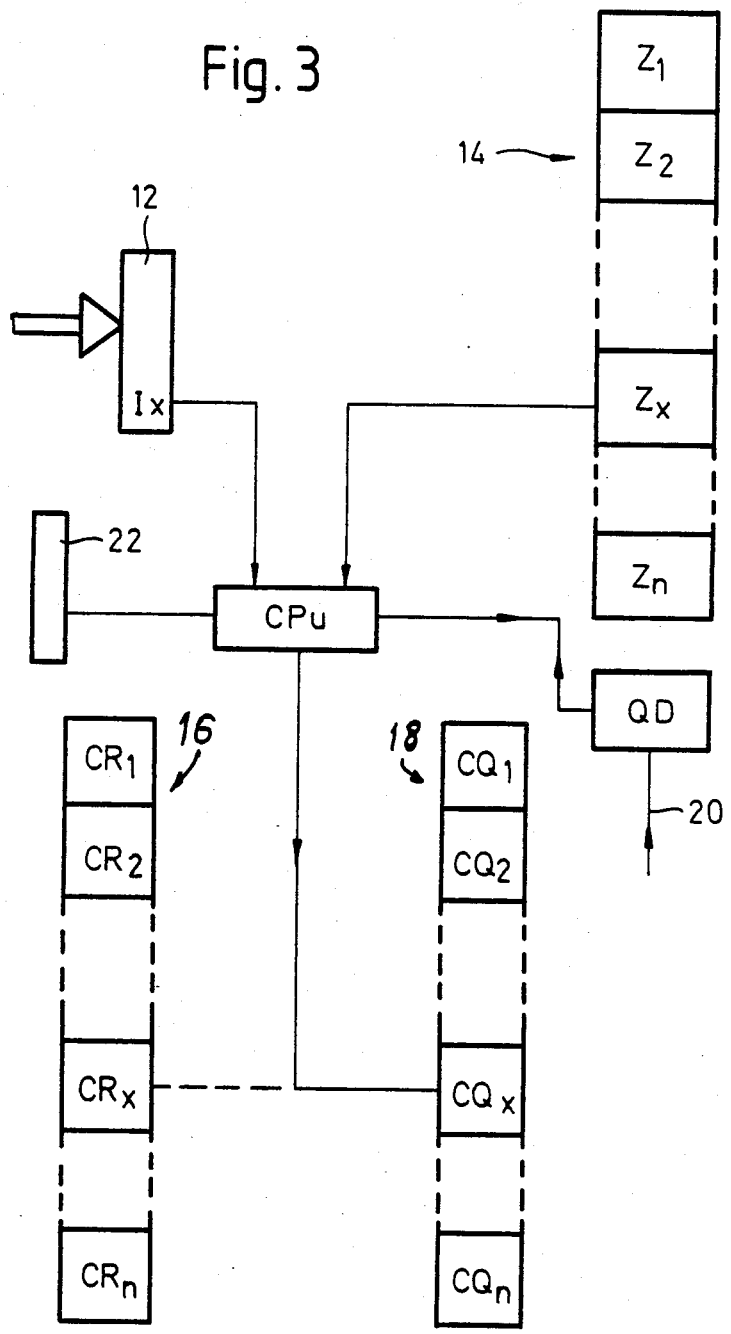
FIG. 3 is a further block diagram of an arrangement constructed in accordance with the present invention and incorporating and interlinking the systems of FIGS. 1 and 2 to extract more useful information.

Referring now to the drawing in detail, and first to FIG. 1 thereof, it may be seen that the reference numeral 10 has been used therein to identify a rotor spinning machine, only a portion of which is illustrated, and the construction and operation of which are well known in the yarn processing industry, so that it is sufficient to illustrate the same diagrammatically. For example, U.S. Pat. No. 3,375,649 shows the overall layout and arrangement of one such machine. However, many variations in the layout are known and used in practice, and the invention is not limited to any one such layout.

As diagrammatically indicated in FIGS. 1 and 2, the machine 10 is subdivided or organized into a plurality of "sections S1, S2, etc. The organization within each section S1, S2, etc. is the same and accordingly, only the first section S1 will be specifically addressed in the present description, the principles to be described applying without change to all other machine sections S2, etc.

Each machine section S1, S2, etc. comprises a plurality of spinning "stations" or "positions". For purposes of illustration of the principles involved, it has been postulated that the section S1 comprises eight stations that are respectively identified by reference characters B1 to B8. These stations B1 to B8 are arranged in two parallel rows on opposite sides of the machine 10. In practice, a machine section, such as S1, would comprise many more stations like the stations B1 to B8, for example twenty. The machine 10 might then comprise ten or eleven sections S1, S2, etc. arranged in a row. For convenience, it is assumed that the machine 10 in question has a total of Bn spinning stations similar or identical to those identified as B1 to B8.

Eaching spinning station B1 to Bn is arranged to receive a feed of fiber sliver and to convert the sliver by means of a rotor spinning unit into a yarn which is passed from the rotor unit to a suitable windup. This is well known in the art, so that no attempt has been made to illustrate the same. Drives and certain ancillary services for the various spinning stations B1 to Bn may be provided from common drive or energy sources (for example, as described in the U.S. Patent referred to above), but the spinning stations B1 to Bn are independently operatable in the sense that interruption of spinning at one individual station such as B1 has no effect upon spinning at any other station such as B2 to Bn of the machine 10.

Assuming that the machine 10 as a whole is in operation, interruption of spinning at any one of the stations B1 to Bn, for example at the station Bx, can be caused by any one of a number of causes, for example only by (a) a random thread break at such station Bx, (b) exhaustion of the sliver supply to such station Bx, (c) a defective spinning unit or other station element so that such station Bx has been taken out of operation, or (d) completion of winding of a yarn package of a predetermined given length followed by induced interruption of operation of such spinning station Bx (by a control system which is not shown) to await a doffing operation.

It will be seen, therefore, that each of the spinning stations B1 to Bn can be in one of a plurality of "operating conditions". For the purposes of the present description, it is sufficient to assume that the monitoring system to be described recognizes and distinguishes between two basic "operating conditions", namely "unit spinning" and "unit not spinning". The various possible classifications of at least the second condition are of no significance to the present considerations.

Associated with each section S1, S2, etc. is a respective monitoring and control unit MC, the unit for the section S1 being indicated at MC1. As indicated by the double-headed arrow in FIG. 1, the unit MC1 is linked to each spinning station B1 to B8 in its section S1, and monitors and controls the conditions of those stations B1 to B8. As referred to in the introductory part of this specification, monitoring and control devices of the same type as the unit MC1 are now well known in the rotor spinning art, and details thereof will be omitted.

The unit MC1 forms a part of a data transmission system indicated diagrammatically at DT, by means of which selected information concerning the operating conditions of all spinning stations B1 to B8 or B1 to Bn can be passed to a central monitoring unit CMU. The central monitoring unit CMU may be provided as a part of the machine 10, or may be separate therefrom, being associated with a plurality of such machines 10. In any event, each section monitoring and control unit (such as the unit MC1) of the machine 10 is linked to the central unit CMU via the data transmission system or link DT. The link DT has been provided with a single arrow head showing transfer of data from the machine 10 to the central unit CMU. In practice, however, data and control signals will also be transferred on this link DT from the central unit CMU to the machine 10.

The central unit CMU comprises an input store or buffer 12 and a storage register 14. The register 14 contains cells Z1, Z2 . . . Zn correlated respectively to the spinning stations B1, B2 . . . Bn. Each of the cells Z1 to Zn contains data representing the current operating condition of its associated spinning station B1 to Bn. A suitable sampling system of any known construction (not shown) interrogates each of the spinning stations B1 to Bn via the data link DT and the section control units MC in accordance with a predetermined sampling cycle which is repeated at a frequency adequate to ensure that the information in the register 14 is maintained "current". The information derived from the spinning stations B1 to Bn in each sampling cycle is temporarily stored in the buffer 12. The information temporarily stored in the buffer 12 is used to update the contents of the register 14 and is then discarded in order to leave the buffer 12 free to receive new information during the next sampling cycle.

The system outlined above with reference to FIG. 1 is already well known to persons skilled in the design of yarn processing machinery and, accordingly, the operating details of the system have been omitted. Such details are, in any event, subject to continual change with the rapid advance in modern electronic technology. For the purposes of the present description, one significant point is that a central register (register 14 in FIG. 1) contains a "picture" of the current operating condition of the spinning stations B1 to Bn.

In FIG. 2, the arrangement of the sections S1, S2, etc. of the machine 10 is the same as before, and so is the arrangement of the spinning stations B1 to Bn in the sections S1, S2, etc. FIG. 2 shows, however, an electronic system which is different from that of FIG. 1. This different system is not alternative to that represented in FIG. 1; rather, it is additional thereto. The two systems operate independently in the sense that each detects and evaluates different types of conditions. The system of FIG. 1 provides a data base for calculation of various operating efficiency characteristics and possibly also for other calculations related to the current operating conditions of the spinning stations B1 to Bn. As will be described, the system shown in FIG. 2 monitors the quality of the product produced at the spinning stations B1 to Bn.

Each of the spinning stations B1 to Bn comprises its own individual yarn quality monitoring device that is of a known construction and hence has not been illustrated. As indicated in the introductory part of the specification, such monitoring devices are readily available commercially and are well documented in patent literature. They are designed to detect yarn "defects", a "defect" being defined as a deviation from a predetermined standard. Within the design limits of the monitoring devices, the standard can be set by the machine user. The monitoring devices are commonly either of the photo-electric or of the electrostatic type and they monitor the cross section of the yarn or the quantity of yarn material in the measuring field of the monitoring device. Each monitoring device produces an electrical output signal which, as indicated by the double-headed arrows in FIG. 2, is passed to an evaulation device E. For ease of illustration, it has been assumed in FIG. 2 that there is one evaluation unit E for each machine section S1, S2, etc. but this is by no means essential.

The electrical signal issued by each individual monitoring device is evaluated in its appropriate unit E with respect of predetermined criteria. The relevant criteria depend upon the type of yarn being processed and its intended use. For rotor spun yarn, commonly used criteria are (a) thickening of a yarn region in excess of a predetermined minimum cross section, regardless of the length of the thickened region, (b) thickening of a yarn region to a cross section in excess of a predetermined minimum, which is lower than the "threshold" specified for case (a) above, where the length of the thickened region also exceeds a predetermined minimum, and (c) periodic variations in yarn cross section, particularly those having a period related to the speed of angular rotation of the rotor of the spinning station B1 to Bn. This list of criteria is not, however, intended to be exhaustive or complete; other criteria, for example, thinning of yarn regions, can also be used for rotor spun yarn and totally different criteria may be relevant to yarns spun by different spinning systems.

When the evaluation unit E detects a defect, as represented by a departure of the output signal of the monitoring device at a particular spinning station B1 to Bn out of a predetermined set range, the section evaluation unit E sends a signal to the correponding one of the spinning stations B1 to Bn, causing an interruption of the spinning operation at that station B1 to Bn. At the same time, the unit E issues a "defect signal" on a link L connecting it to a central quality control unit Q. There is one link L for each evaluation unit E, only three such links being shown in FIG. 2, although a practical machine would include many more such links L. The evaluation unit E communicates directly with the spinning station B1 to Bn which had produced the defect, so that the operation of only this station B1 to Bn is interrupted as a result of the defect. However, the signal passed to the central unit Q merely indicates that a "quality defect" has occurred, without identifying the relevant spinning station B1 to Bn, or even the section S1, S2, etc., which produced the defect.

After interruption of spinning, a suitable service operation can be performed and the out-of-use spinning station B1 to Bn can then be put back into operation. In the case of yarn region thickening defect, the defective yarn region will be cut out from the yarn wound into the thread package and a "piecing" or splicing will be performed before or during the restarting of the spinning station B1 to Bn. In case of a periodic yarn fault, the cause of the fault can generally be removed by cleaning the rotor, whereupon the station B1 to Bn can again be put into operation by performing a "piecing" operation. The fact that a particular spinning station, say station Bx, has ceased operation will be recorded in the register 14, and the restarting of the operation at the station Bx will also be recorded in that register 14.

Turning now to FIG. 3, it may be seen that it shows a construction of the central monitoring unit CMU that is modified in accordance with the present invention. The input buffer 12 and the register 14 are unchanged. However, two additional registers 16 and 18 respectively, are now additionally provided in the unit CMU. The register 16 contains cells CR1 to CRn that are associated with the stations B1 to Bn, respectively, and the register 18 contains cells CQ1 to CQn that are also associated with the stations B1 to Bn, respectively. Each of the CR cells will contain data representing the number of random thread breaks occurring at its respectively associated spinning stations B1 to Bn over a predetermined time period which can be selected by the user. Each of the CQ cells will contain data representing the number of quality defects occurring at its respectively associated spinning station B1 to Bn over the same time period. Entry of data into the register 16 and 18 occurs under the control of the central processing unit CPU.

An additional storage element QD is also provided and has an input 20 from the central unit Q of the quality monitoring system that has been described above with reference to FIG. 2. Each time a quality defect is registered in the unit Q, a signal is supplied to the input 20, so that the storage element QD is set in a first condition. The element QD can then be reset to a second condition by the processor CPU, in a manner that will be described below.

Assume now that the buffer 12 contains data Ix representing the condition of the spinning station Bx during the current sampling cycle. The corresponding cell Zx in the register 14 contains data representing the condition of the station Bx during the preceding sampling cycle. As indicated in FIG. 3, these two conditions can be compared by the processor CPU. If they are the same, or if they indicate that station Bx has been put back into operation after an interruption, then no further steps are required or performed as far as the present invention is concerned. If, however, this comparison indicates that spinning has been interrupted at station Bx since the sample stored in Zx was taken, then the processor CPU examines the current state of the storage element QD. Such interrogation or examination is accomplished in a well known manner that need not be explained here in detail. If the element QD is in its first condition, then the processor CPU enters "defect" data in the cell CQx of the register 18 (as indicated by the full line joining the processor CPU with that cell CQx). If, however, the element QD is in its second condition when interrogated by the processor CPU, then the processor CPU enters a "random thread break" in the cell CRx of the register 16, as indicated by the dashed line link.

Simultaneously with the entry of defect data in the cell CQx of the register 18, the processor CPU resets the element QD to its second condition. Thus, when the processor CPU passes to data representing the condition of the next spinning station BX+1, in the event that the comparison of the data indicates that spinning has also been interrupted at this station between the current sampling cycle and the preceding cycle, a "random thread break" will be entered in the appropriate CR cell of the register 16, except in the improbable event that a second defect signal is applied to the element QD immediately after that element QD was reset by the processor CPU. It will be understood, therefore, that the system operates to associate a quality defect with the first-sensed interuption of the spinning to occur after the entry of the defect data in the element QD. The system is, therefore, not free from the theoretical possibility of error. However, provided that the signal transmission times in the condition and quality monitoring systems are maintained sufficiently short, errors which may arise in practice will be statistically insignificant. This can be seen from the timing diagram shown in FIG. 4 which, however, is provided merely as an example of the timing achievable by currently availabl condition and quality monitoring systems.

Figure 4:
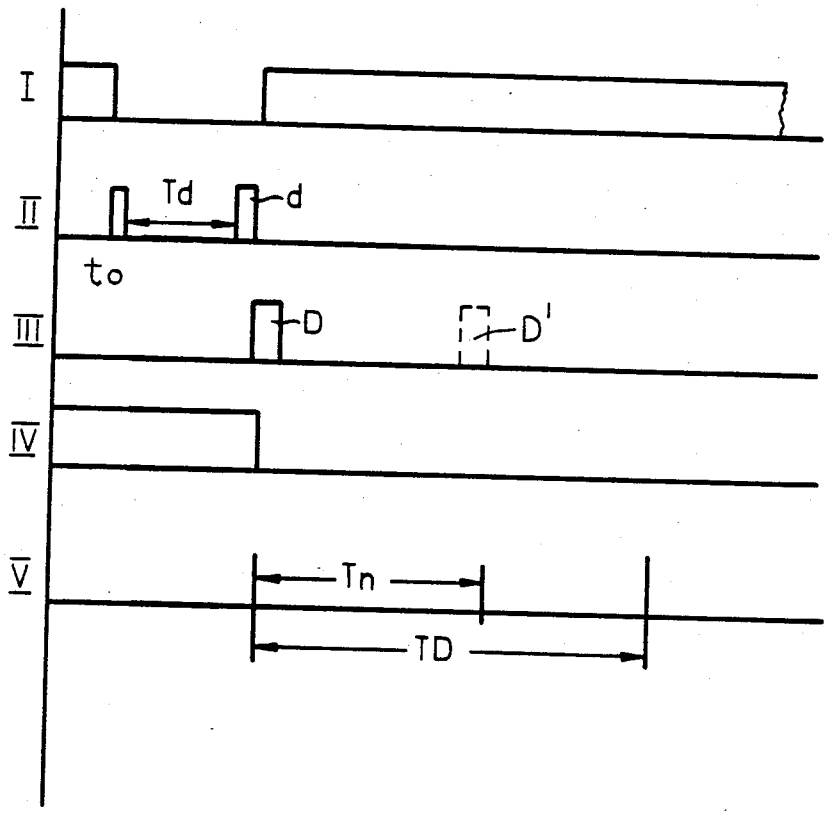
FIG. 4 is a timing diagram of certain conditions and signals representative thereof as they are encountered during the operation of the system of the present invention as depicted in FIG. 3.

FIG. 4 assumes the use of an arrangement in which each spinning station B1 to Bn includes a clutch which controls the operation of a feed device that feeds sliver into the spinning unit of the respective station B1 to Bn (see for example U.S. Pat. No. 3,375,649 referred to above). Taking an arbitrary spinning station Bx again as an example, the feed clutch of this station Bx can be controlled by a signal represented at the uppermost line I of FIG. 4. When the signal on the line I is high, the feed clutch of the station Bx is free and can be closed to cause the feeding of the sliver into the station Bx. When the signal on the line I is low, the clutch is locked open so that the sliver cannot be fed into the station Bx. However, the signal on the line I alone is incapable of closing the feed clutch; rather, such closure must be effected by other means, for example by a travelling piecing unit after the performance of any required service operations at the spinning station Bx.

Line II in FIG. 4 represents the output of the evaluation unit E monitoring the yarn produced by the station Bx. Assume that at the time t0 a yarn defect is detected by the evaluation unit E. The unit E then immediately sends the signal I low. However, spinning is not immediately interrupted at the station Bx; rather, there will be a certain delay in the opening of the feed clutch, a further inertial delay in the termination of the feeding, and a small "stock" of fibers already fed into the rotor must be used up before spinning actually stops. There is, therefore a variable time delay Td until the yarn monitor at the station Bx detects the fact that the yarn cross section has fallen below a predetermined lower threshold value and issues a further defect signal d. Either of the pulse signals on the line II (for example as illustrated in FIG. 4, the "spinning termination" signal d) can cause the quality monitor Q to supply a defect signal D shown on line III of FIG. 4 to the input 20 of the storage element QD (seen in FIG. 3) setting that element QD in its first condition as described above.

Assume also that each of the spinning stations B1 to Bn includes a thread break monitoring device (not shown) separate from the yarn quality monitoring device and supplying an output signal appearing on line IV of FIG. 4. Such thread break monitoring devices normally respond to yarn tension and are well known in this art. When the thread tension is above a predetermined minimum value, the signal depicted on the line IV is high, and this signal goes low when the yarn tension drops below the predetermined minimum. This will occur slightly after the issuance of the signal d. When the signal on the line IV goes low, the signal on the line I goes high. The feed clutch is therefore once again free for closure to enable piecing by a travelling piecing device as described previously.

The condition of the thread break monitoring device at the station Bx will be interrogated in a well known manner by the appropriate section monitor MC, and eventually by the central monitoring unit CMU shown in FIG. 1. Due to transmission delays in the system illustrated in FIG. 1, a signal indicating the change in condition of the thread break monitoring device at the station Bx will be available at the processor CPU shown in FIG. 3 with a minimum delay Tn following the actual change in condition of that monitoring device. Additional delay may be caused by the sampling system, in particular the stage of a sampling cycle during which the thread break occurs at the station Bx in comparison with the stage of the sampling cycle during which the station Bx is interrogated. Accordingly, a maximum anticipated delay TD can be defined at the expiration of which the central processing unit CPU will be able to associate the thread break and quality defect signals.

It follows from the above remarks that the quality defect signal should be available at the storage element QD before the expiration of the minimum delay for arrival of the thread break signal at the central monitoring unit CMU. In this way, the risk of a "mis-association" can be minimized. This is indicated by a dotted pulse D1 on line III in FIG. 4.

The system should or could also include display means, indicated at 22 in FIG. 3, for presenting the stored information to the machine user. Transfer of information from the registers 14, 16 and 18 to the display device 22 occurs under the control of the processor CPU. That processor CPU can also carry out calculations based upon the information in the registers 14, 16 and 18, so as to provide at the display 22, for example, efficiency values based upon the number of those of the stations B1 to Bn that are currently operating as a percentage of the total number of the stations B1 to Bn in the machine 10, identification of the stations B1 to Bn with the worst record with respect to random thread breaks, calculation of the number of quality defects per specified period (for example 1,000 operating hours) and any other desired values which can be derived from the available stored data.

The display device 22 may be a visual device, for example a television-type screen or the display window of a portable calculator-type instrument. Alternatively, the display device 22 could be a printer. Any other display device 22 could, however, be substituted for those mentioned. As indicated by the reference to a portable calculator-type instrument, the display device 22 need not be permanently connected to the processor CPU; rather, it may be plugged into a suitable socket to enable readout of the stored information upon demand.

The information stored in the system shown in FIG. 3 may also be used for control purposes. For example, an unduly high number of quality defects during a given operating period at a station Bx may be taken as an indication of faulty operation either of the respective spinning station Bx or of the yarn monitoring device arranged at that station Bx. Appropriate fault signals could be produced and could be used to operate an alarm or to induce interruption of spinning at the station Bx concerned.

The storage registers, storage elements and data processing units may be provided in a microcomputer and the various operating steps may be carried out under the control of a suitable program for such a computer.

It will be understood that each of the elements described above, or two or more together, may also find a useful application in other types of arrangements differing from the type described above.

While the invention has been illustrated and described as embodied in a rotor spinning machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, thererfore, such adaptations should and are intended to be comprehended within the meaning and range of equivalence of the claims.

What is claimed as new and desired to be protected by Letters Patent is set forth in the appended claims:

1. An arrangement for evaluating the performance of a yarn processing machine having a plurality of independently operatable yarn processing stations each of which can be at any given time in one of its "operating" and "non-operating" conditions and is equipped with a condition monitoring device operative for issuing first signals representative of a change from the "operating" to the "non-operating" condition of the station, and with a yarn quality monitoring device operative for issuing at least a defect signal indicative of defective yarn quality at the station, and means common at least to a group of the stations for issuing a combined second signal indicative of the issuance of a defect signal by any respective one of the group of stations, but not identifying the respective station and for changing from "operating" to "non-operating" the condition of the respective station, comprising means for separately supplying said first signals from all of said condition monitoring devices and said second signal to an evaluation location; and means situated at said evaluation location and connected to said supplying means for associating said second signal with the appropriate one of the yarn processing stations on the basis of that of the first signals which occurs first after the occurrence of said second signal.

2. The arrangement as defined in claim 1, wherein at least some of the first signals are indicative of yarn break at the associated stations; and wherein said associating means includes a first storage device for storing data representative of random yarn breaks at the associated stations, a second storage device for storing data representative of quality defects at the associated stations, and means for entering data into said second storage device in response only to each sequence of said second signal and that of said first signals which immediately follows said second signal and is of the type representative of a change in the condition of the associated station that is indicative of a yarn break at such station, and into said first storage device in response at least to the remaining ones of said first signals of said type.

3. A method of evaluating the performance of independently operatable yarn processing stations of a yarn processing machine, comprising the steps of monitoring the current operating condition of each of the stations and issuing first signals representative of a change in such condition from "operating" to "non-operating", at least some of the first signals being representative of a yarn break at the associated station; monitoring the yarn quality at each of the stations and issuing defect signals representative of the occurrence of yarn quality defects at the respective stations and a combined second signal indicative of the issuance of the defect signal at any of the stations but not of the identity of the associated station; changing from the "operating" to the "non-operating" the condition of the station associated with the respective defect signal; and associating the respective second signal with a change in said first signal that is representative of the occurrence of a yarn break at the associated station.

* * * * *